US005292092A

United States Patent [19]

Curtis et al.

[11] Patent Number: 5,292,092

[45] Date of Patent: Mar. 8, 1994

[54] RETROFIT BRACKET FOR WALL MOUNT SPEAKERS

[75] Inventors: Jerry Curtis, Laguna Niguel; William J. Kindel, San Clemente; Geoffrey L. Spencer, Laguna Niguel; Scott Struthers, San Clemente; F. Hendrik Huebscher; Walter Malzahn, both of Mission Viejo; Ronald Maurer, El Cajon, all of Calif.

[73] Assignee: Dana Innovations, San Clemente, Calif.

[21] Appl. No.: 54,082

[22] Filed: Apr. 26, 1993

[51] Int. Cl.[5] ..... G12B 9/00

[52] U.S. Cl. ..... 248/27.1; 381/188; 455/350

[58] Field of Search ..... 248/906, 27.1, 27.3, 248/56; 312/7.1; 361/427, 422; 220/3.9; 381/188; 362/365

[56] References Cited

U.S. PATENT DOCUMENTS

| | | | |
|---|---|---|---|
| 2,522,859 | 9/1950 | Carbonneau | 455/350 |
| 2,604,285 | 7/1952 | Knoch | 248/27.1 |
| 3,180,595 | 4/1965 | Brunsting | 248/27.3 |
| 3,327,984 | 6/1967 | Rennie . | |
| 3,369,784 | 2/1968 | Whitney | 248/27.1 |
| 3,664,615 | 5/1972 | Kruger | 248/27 |
| 3,727,004 | 4/1973 | Bose | 179/1 D |
| 3,912,865 | 10/1975 | Seebinger | 179/1 E |
| 4,133,975 | 1/1979 | Barker | 179/1 E |
| 4,250,540 | 2/1981 | Kristofek . | |
| 4,266,092 | 5/1981 | Barker | 179/1 E |
| 4,439,643 | 3/1984 | Schweizer | 179/146 |
| 4,444,369 | 4/1984 | Job | 248/27 |
| 4,546,850 | 10/1985 | Litner | 381/188 |
| 4,614,374 | 9/1986 | Lannert . | |
| 4,688,596 | 8/1987 | Liebmann . | |
| 4,727,587 | 2/1988 | Black | 381/188 |
| 4,760,510 | 7/1988 | Lahti | 362/365 |
| 4,778,134 | 10/1988 | Struthers et al. | 248/27 |
| 4,815,558 | 3/1989 | Krainhofer | 181/141 |
| 4,853,966 | 8/1989 | Skrzycki | 381/188 |
| 4,961,226 | 10/1990 | Saffran | 381/24 |
| 5,027,403 | 6/1991 | Short et al. | 381/24 |
| 5,082,083 | 1/1992 | Draffen | 181/150 |
| 5,088,574 | 2/1992 | Kertesz | 181/150 |
| 5,143,339 | 9/1992 | Ashcraft et al. | 248/343 |
| 5,205,755 | 4/1993 | Douty | 248/27.1 X |
| 5,221,069 | 6/1993 | Struthers et al. | 248/231.9 |

OTHER PUBLICATIONS

Boston Acoustics brochure for Designer Series In-Wall Loudspeaker Systems dated 1991.

*Primary Examiner*—J. Franklin Foss

*Attorney, Agent, or Firm*—Stetina and Brunda

[57] ABSTRACT

A retrofit bracket for wall mount speakers has a support surface configured for mounting at least one speaker thereto and a pair of elongate clamping bars extending across to opposite sides of the rear of the support surface and adjustably attach thereto such that a wall covering is clampably capturable intermediate the support surface and the bars. An adjustment means facilitates varying of the distance between the support surface and the bars to accommodate various wall covering thicknesses. The elongate bars are sufficiently flexible to provide spring tension against the wall covering captured intermediate the bars and the support surface. A foot is formed upon each end of the elongate bars for distributing the force applied by the bars over an increased surface area. The use of feet to spread the force of the bars over an increased surface area mitigates the potential for compression of the wall covering captured therebeneath. The use of bars which are sufficiently flexible to provide spring tension against the wall covering provide for continued tension of the feet against the wall covering as the wall covering compresses. Thus, the retrofit bracket for wall mount speakers of the present invention provides a means whereby speakers mounted to a wall covering are not susceptible to loosening due to compression of the wall covering and consequently are not susceptible to the degradation of performance and appearance caused thereby.

20 Claims, 3 Drawing Sheets

RETROFIT BRACKET FOR WALL MOUNT SPEAKERS

FIELD OF THE INVENTION

The present invention relates generally to mounting brackets and more particularly to a retrofit bracket for wall mount speakers whereby wall mount speakers and the like are easily mounted to an existing wall in a manner which mitigates the potential for subsequent loosening of the mount due to compaction of the wall surface and/or vibration.

BACKGROUND OF THE INVENTION

The demand for high-quality speakers has increased dramatically over the last twenty years. As a consequence, there is a large selection of high-quality speakers available on the market. Unfortunately, speakers are somewhat bulky and cumbersome. There has consequently been a demand to mount speakers in the ceilings and walls. The mounting of high-quality speakers in a ceiling or wall is an expensive enterprise, particularly since brackets must typically be custom made, and frequently considerable effort is required in the fabrication of such brackets.

This is of particular concern in pre-existing wall structures wherein a retrofit bracket must be utilized. In such retrofit applications, an opening is typically formed within the wall surface and the bracket is then inserted through the opening and attached to the wall surface and/or studs disposed within the wall. As will be recognized, this is a difficult and time consuming process.

Furthermore, after installation, such prior art brackets are subject to loosening wherein portions of the wall covering supporting the mounting bracket compact or compress. Compression of the wall covering is of particular concern where drywall or the like is utilized and the wall mount speaker bracket is clamped thereto. Clamping the bracket to such a wall covering typically involves utilizing a clamping member to apply pressure to the wall covering which is captured intermediate a clamping member disposed within the wall and a portion of the bracket disposed outside of the wall covering. As the wall surface compresses due to the pressure of the clamping member, the bracket loosens.

Additionally, vibrations from the speaker—particularly over an extended length of time—tend to loosen contemporary wall mount speakers. Vibration frequently causes fasteners to loosen, thereby reducing their effectiveness in mounting the speaker assembly. For example, it has been observed that after extended periods of time nuts and bolts tend to loosen and nails tend to pull out. Thus, mounting of in-wall speakers is typically more troublesome than the mounting of other items, i.e., light fixtures.

Such loosening of the bracket allows the bracket, speaker, and/or wall surface to vibrate as a result of acoustic energy radiated by these speakers. This vibration results in annoying audible rattling, thus degrading the performance of the in-wall speaker system. In addition to such acoustic rattling, the in-wall speaker may also be displaced or moved from its intended position, much like a picture in need of straightening.

As such, it is desirable to provide a retrofit bracket for wall mount speakers wherein speakers may easily be mounted within existing wall structures without requiring the fabrication of a custom bracket and wherein the bracket is not subject to loosening due to compression of the wall covering.

SUMMARY OF THE INVENTION

The present invention specifically addresses and alleviates the above mentioned deficiencies associated in the prior art. More particularly, the present invention comprises a retrofit bracket for wall mount speakers and has a support surface configured for mounting at least one speaker thereto. It also has a pair of elongate clamping bars extending across to opposite sides of the support surface and adjustably attached thereto such that a wall covering is clampably capturable intermediate the support surface, typically a bezel, extending thereabout, and the clamping bars.

An adjustment means facilitates varying of the distance between the support surface and the clamping bars to accommodate various wall surface thicknesses. The elongate clamping bars are sufficiently flexible to provide spring tension against the wall covering captured intermediate the bars and the support surface. The clamping bars are preferably comprised of a molded plastic material such as glass filled ABS. Those skilled in the art will recognize that various other materials are likewise suitable.

A foot is formed upon each end of the elongate bars for distributing the force applied by the bars over an increased surface area. That is, the feet have a larger surface area than the cross-section area of the bars, i.e., the feet are flared out portions of the bars.

The use of such feet to spread the force of the bars over an increased surface area mitigates the potential for compression of the wall surface captured therebeneath. The use of bars which are sufficiently flexible to provide spring tension against the wall surface provide for continued tension of the feet against the wall covering as the wall covering compresses. Thus, the retrofit bracket for wall mount speakers of the present invention provides a means whereby speakers mounted to a wall covering are not susceptible to loosening due to compression of the wall surface and consequently are not susceptible to the degradation of performance commonly caused thereby.

The retrofit bracket of the present invention may also be utilized to mount other in-wall fixtures, such as those associated with doorbells, fans, lighting and/or sound controls, etc.

These, as well as other advantages of the present invention will be more apparent from the following description and drawings. It is understood that changes in the specific structure shown and described may be made within the scope of the claims without departing from the spirit of the invention.

DETAILED DESCRIPTION OF THE PREFERRED EMBODIMENT

The detailed description set forth below in connection with the appended drawings is intended as a description of the presently preferred embodiment of the invention, and is not intended to represent the only form in which the present invention may be constructed or utilized. The description sets forth the functions and sequence of steps for constructing and operating the invention in connection with the illustrated embodiment. It is to be understood, however, that the same or equivalent functions of sequences may be accomplished by different embodiments that are also intended to be encompassed within the spirit and scope of the invention.

Figure 1:
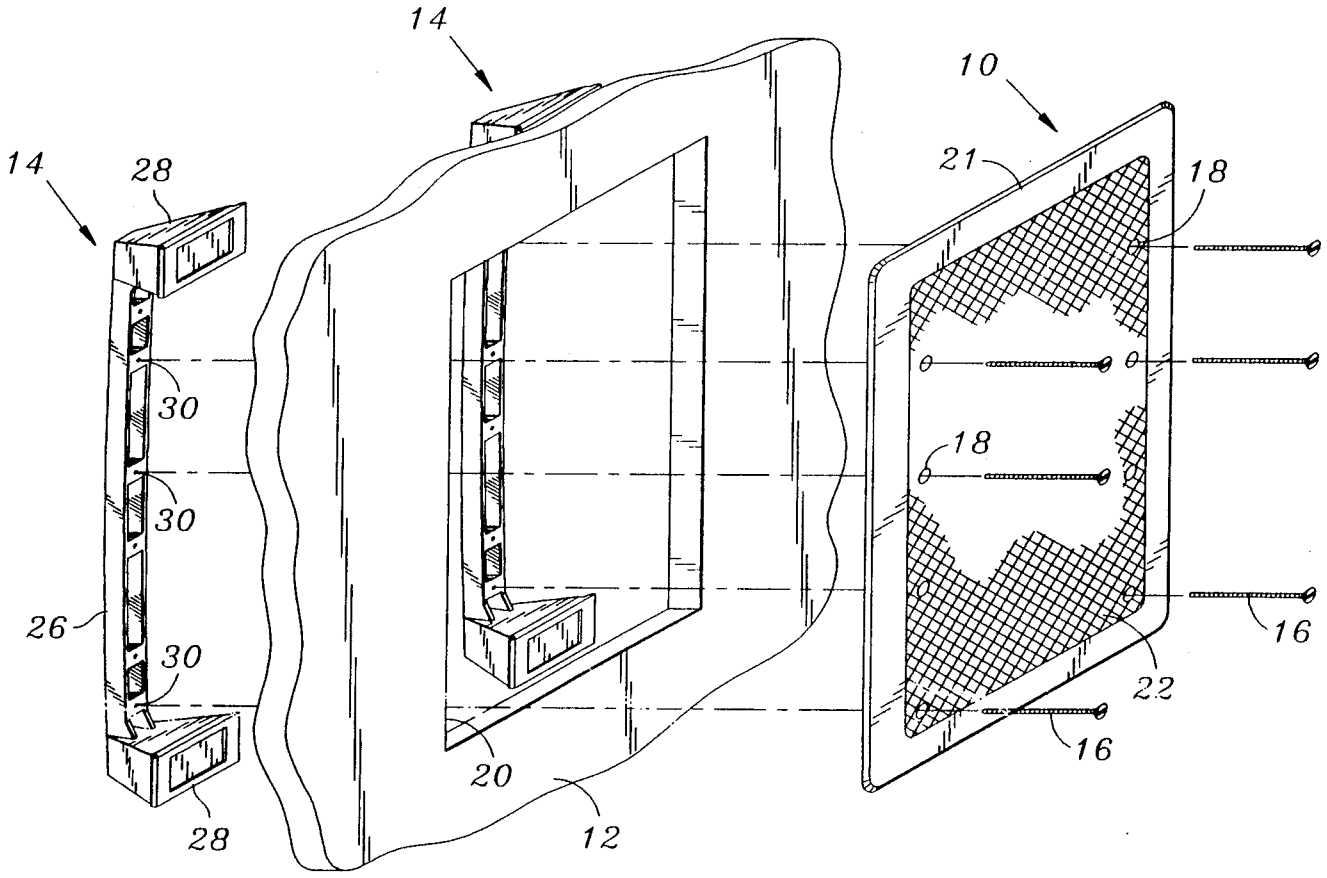
FIG. 1 is an exploded perspective view of the retrofit bracket for wall mount speakers of the present invention showing how it is to be mounted to a wall surface.
Figure 2:
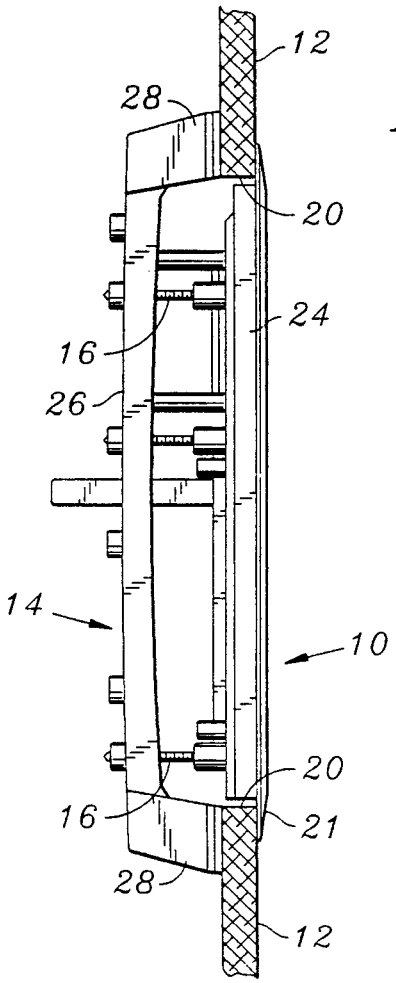
FIG. 2 is a cross-sectional side view of a wall surface having a retrofit bracket for wall mount speakers of the present invention attached thereto.

The retrofit bracket for a wall mount speaker of the present invention is illustrated in FIGS. 1-5, which depict a presently preferred embodiment of the invention. Referring now to FIGS. 1 and 2, the retrofit bracket of the present invention generally comprises a bracket or support surface 10 attached to the outside of a wall covering 12 and a plurality, preferably two, of generally parallel elongate clamping bars 14 disposed on the inside of the wall covering such that the wall covering 12 is clamped between the support surface 10 and clamping bars 14.

Adjustable attachment means or screws 16 pass through apertures 18 formed in the bracket support surface 10 and through aperture 20 formed in the wall covering 12 to threadably attach to clamping bars 14. Those skilled in the art will recognize that various other means for adjustably attaching the support surface 10 to the clamping bars 14 are likewise suitable. It is only necessary that the distance between support surface 10 and the clamping bars 14 be adjustable such that the wall surface 12 is clampably capturable therebetween.

The support surface 10 is configured to receive at least one speaker. It comprises a bezel 21 sized to cover the aperture 20 formed within the wall covering 12 and preferably further comprises a grille 22 to cover the speakers. The grille preferably covers and obscures from view the apertures 18 and the screws 16. The support surface preferably further comprises insertion member 24 received within aperture 20 formed in the wall covering 12. The insertion number 24 is configured in a complimentary fashion to aperture 20, i.e., rectangularly configured for a rectangular aperture.

Figure 3:
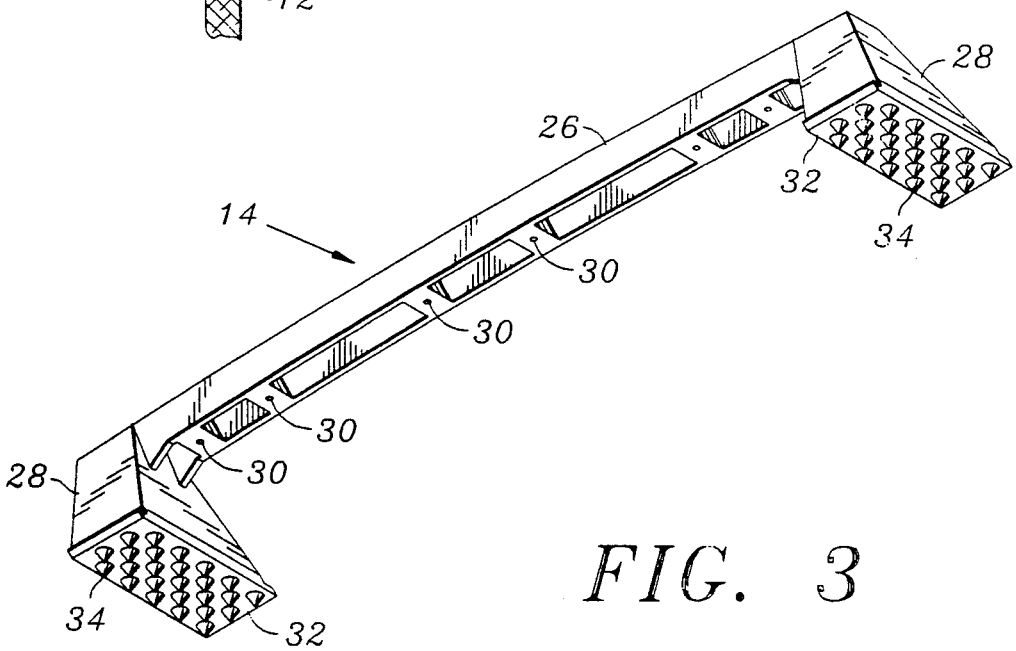
FIG. 3 is an enlarged perspective view of a clamping bar.

Referring now to FIG. 3, each clamping bar comprises a bowed elongate member 26 and feet 28 formed at either end thereof. The feet 28 flare or increase the contact area of the bowed elongate member 26 such that the force applied thereby to the wall covering 12 is spread over an increased surface area. Compression of the wall covering 12 is thus substantially mitigated.

The bowed elongate member 26 is preferably arched outward, away from the bracket support surface 10 such that tightening of the screws 16 results in deformation, preferably straightening, thereof. The bowed elongate 26 is formed of a sufficiently resilient material that such straightening thereof results in spring pressure being applied to the wall covering 12 by the feet 28. Thus, any compression of the wall covering 12 resulting from its being clamped intermediate the feet 28 of the clamping bars 14 and the bezel 20 of the support surface 10 does not result in loosening of the retrofit bracket of the present invention. Rather, such compression is accommodated by movement of the feet 28 toward the bezel 20 due to the resiliency or spring nature of the bowed elongate member 26, thus resulting in maintenance of the clamping force applied to the wall covering 12 by the retrofit bracket of the present invention.

Each clamping bar 14 further comprises a plurality of threaded apertures 30 which receive the adjustment means or screws 16 prior to attachment thereof to the support surface 10 and which effect clamping of the present invention to the wall covering 12. A number of such threaded apertures 30 in excess of that required for any particular mounting may be provided to accommodate variations in the configuration of the support surface 10. That is, extra threaded apertures 30 may be provided to accommodate various placements of the apertures 18 in the support surface 10, thus allowing the bracket to be used with various different support surfaces 10.

The contact surfaces 32 of the feet 28 optionally comprise gripping means, preferably configured as a plurality of pointed members 34. Such pointed members 34 dig into the inside of the inner surface of the wall covering 12 and thus prevent slippage of the clamping bars 14 after they have been tightened.

Figure 4:
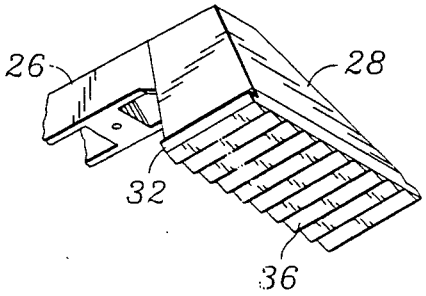
FIG. 4 is an enlarged perspective view of an alternative configuration of the clamping bar of FIG. 3.

Referring now to FIG. 4, the gripping means may alternatively comprise either horizontally or vertically configured saw-toothed grippers 36. However, those skilled in the art will recognize that various other configurations, i.e., knurling, roughened surfaces, etc., are likewise suitable for use as such gripping means.

Figure 5:
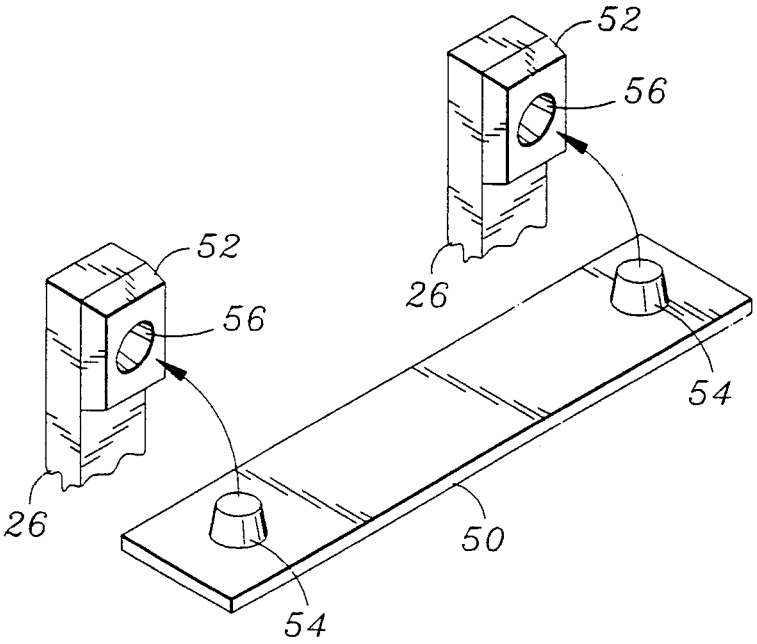
FIG. 5 is an alternative configuration of the feet 28 having a cross-member interconnecting the feet of the two clamping bars.

Referring now to FIG. 5, an alternative configuration of the feet 52 utilizes a cross-member 50 to interconnect each of the adjacent feet 52 of the two bowed elongate members 26. The cross-member 50 both stabilizes the two bowed elongate members 26 and also provides increased surface area for improved gripping. The increased surface area provided by cross-member 50 is particularly advantageous in those conditions wherein the inner surface of the wallboard has become slippery, i.e., from wetting, chalk dust, crumbling, etc. Thus, improved gripping is provided via the use of cross-member 50.

Cross-member 50 attaches to the feet 52 via male members or detents 54 formed upon the cross-member 50 and complimentary female members or detents 56 formed upon the feet 52. Those skilled in the art will recognize that various means for attaching the cross-member 50 to the feet 52 are likewise suitable. The male member 54 and complimentary female members 56 are preferably frusto-conical in configuration. Those skilled in the art will recognize that various configurations of detents may be formed thereon to assure positive engagement of the cross-member 50 to the feet 52.

Use of the cross-bar 50 further facilitates the use of smaller feet 52 such that the clamping bars 14 may be easily inserted within the opening formed in the wallboard.

Various gripping surfaces may be formed upon the wall contact surface of the cross-member 50 to further enhance its ability to grip the inner surface of the wallboard. For example, the serrations of the foot 28 illustrated in FIG. 4 or the pointed members of the foot 28 illustrated in FIG. 3 may be formed upon the surface of the cross-member 50 which contacts the inner surface of the wallboard.

Having thus described the structure of the retrofit bracket for wall mount speakers of the present invention, it may be beneficial to describe the operation thereof. One or more speakers, as desired, are first attached to the bracket support surface 10. The clamp bars are then loosely attached to the bracket support surface 10 by passing screws 16 through apertures 18 formed therein and threading the screw 16 into the threaded apertures 30 of the clamping bars.

If used, the cross-members 50 are attached to the feet 52, generally perpendicular to the bowed elongate members 26. One cross-member 50 is preferably attached to the two lower feet 52 and another cross-member 50 is preferably attached to the upper feet 52 such that two cross-members 50 are utilized, thereby maximizing the ability of the retrofit bracket of the present invention to grip the wall covering.

One end, i.e., the top, of the clamping bars 14 is inserted through the aperture 20 formed in the wall covering 12 and the support surface 10 is then positioned so as to facilitate entry of the opposite end of the clamping bars 14 through the aperture 20. The opposite end of the clamping bars 14 is then pushed through the aperture 20 and the support surface 10 manipulated to position the feet 28 of the clamping bars 14 such that the wall covering 12 is captured intermediate the feet 28 and the bezel 21. The screws 16 are then tightened sufficiently to capture or clamp the wall covering 12 therebetween.

Such tightening of the screws 16 tends to straighten the bowed elongate member 26 of the clamping bars 14. As the wall covering 12 tends to compress, particularly over an extended period of time, the feet 28 are urged toward the bezel 21 as the bowed elongate member 26 tends to resume its bowed configuration. As such, a substantially constant clamping force is applied to the wall covering 12 by the feet 28 and the bezel 21 respective of compression of the wall covering 12. Furthermore, compression of the wall covering 12 is substantially mitigated by the increased surface area of the feet 28 which serve to spread the force or load applied by the clamping bar 14 over an increased surface area of the wall covering 12.

Pointed grippers 34 (FIG. 3) or saw-toothed grippers 36 (FIG. 4) formed upon the contact surface 32 of feet 28 may alternatively maintain positioning of the retro fit bracket by preventing sliding of the feet 28 once the adjustment means or screw 16 have been tightened.

It is understood that the exemplary retrofit bracket for a wall mount speaker described herein and shown in the drawings represents only a presently preferred embodiment of the invention. Indeed, various modifications and additions may be made to such an embodiment without departing from the spirit and scope of the invention. For example, the bowed elongate member 28 need not be any particular cross sectional configuration, but rather may be of any cross sectional configuration which provides sufficient resiliency to maintain clamping force as the wall surface compresses. Also, feet need not be angular as illustrated, but rather may be of any shape or configuration which facilitates spreading of the force supplied by the clamping bar 14 over an increased surface area.

Thus, these and other modifications and additions may be obvious to those skilled in the art and may be implemented to adapt the present invention for use in a variety of different applications.

What is claimed is:

1. A retrofit bracket for wall mount speakers comprising:

(a) a support surface configured for mounting at least one speaker thereto;

(b) at least two elongate bars attached to said support surface such that a wall covering is clampably capturable intermediate said support surface and said bars, each of said bars having a foot formed at each end thereof;

(c) adjustment means for varying the distance between said support surface and said bars;

(d) at least one cross-member interconnecting adjacent feet of the two bars; and (e) frusto-conical male members formed upon said cross-member and complimentary frusto-conical female members formed within said feet to facilitate attachment of the cross-member to the feet;

(f) wherein said adjustment means facilitates the accommodation of various wall covering thicknesses.

2. The bracket as recited in claim 1 wherein said bar is sufficiently flexible to provide spring tension against the wall covering captured intermediate said bar and said support surface.

3. The bracket as recited in claim 1 wherein said bar is bowed to provide spring tension against the wall covering captured intermediate said bars and said support surface.

4. The bracket as recited in claim 1 wherein said elongate bars are generally parallel.

5. The bracket as recited in claim 1 wherein said foot distributes the force applied by said bar over an increased surface area.

6. The bracket as recited in claim 1 wherein said support surface further comprises:

(a) an insertion member which is insertable through a hole formed in the wall covering; and (b) a bezel which remains upon the wall covering.

7. The bracket as recited in claim 1 wherein said bars are sufficiently flexible to maintain spring tension against the wall covering upon compression of the wall covering.

8. A retrofit bracket for wall mount speakers comprising:

(a) a support surface configured for mounting at least one speaker thereto;

(b) at least two elongate bars attached to said support surface such that a wall covering is clampably capturable intermediate said support surface and said bars, each of said bars having a foot formed at each end thereof;

(c) adjustment means for varying the distance between said support surface and said bars;

(d) at least one cross-member interconnecting adjacent feet of the two bars; and (e) first connectors formed upon said cross-member and second connectors formed upon said feet, said first and second connectors being mateably engageable to facilitate attachment of the cross-member to the feet;

(f) wherein said adjustment means facilitates the accommodation of various wall covering thicknesses.

9. The bracket as recited in claim 8 wherein said bar is sufficiently flexible to provide spring tension against the wall covering captured intermediate said bar and said support surface.

10. The bracket as recited in claim 8 wherein said bar is bowed to provide spring tension against the wall covering captured intermediate said bars and said support surface.

11. The bracket as recited in claim 8 wherein said foot distributes the force applied by said bar over an increased surface area.

12. The bracket as recited in claim 8 wherein said support surface further comprises:

(a) an insertion member which is insertable through a hole formed in the wall covering; and (b) a bezel which remains upon the wall covering.

13. The bracket as recited in claim 8 wherein said elongate bars are generally parallel.

14. The bracket as recited in claim 8 wherein one of said first and second connectors comprise male connectors and the other of said first and second connectors comprise female connectors.

15. The bracket as recited in claim 8 wherein said bars are sufficiently flexible to maintain spring tension against the wall covering upon compression of the wall covering.

16. A method for attaching speakers to a wall, the method comprising the steps of:

(a) attaching at least one speaker to a support surface;

(b) attaching at least one elongate bar to the support surface such that the bar extends across two opposite sides thereof;

(c) forming an opening in a wall covering;

(d) inserting the bar through the hole;

(e) adjusting the distance between the bar and the support surface such that the wall covering is captured intermediate the bar and the support surface.

17. The method as recited in claim 16 wherein the step of adjusting the distance between the bar and the support surface comprises adjusting the distance such that the bar resiliently deforms to apply spring tension to the wall covering captured between the bars and the support surface.

18. The method as recited in claim 17 wherein the step of adjusting the distance between the bar and the support surface comprises adjusting the distance between feet formed at both ends of the bar and the support surface, the feet distributing the force applied by the bar over an increased surface area.

19. The method as recited in claim 17 further comprising the step of inserting an insertion member formed upon the support surface into the opening after inserting the bar therethrough.

20. The method as recited in claim 17 wherein the step of adjusting the distance between the bar and the support surface maintains spring tension upon the wall covering upon compression of the wall covering and mitigates degradation of speaker performance caused by such compression.

* * * * *